United States Patent [19]

Pass

[11] 3,966,207

[45] June 29, 1976

[54] STRING SYSTEM FOR A GAME RACKET

[76] Inventor: Roger D. Pass, 1119 W. Montana Ave., St. Paul, Minn. 55108

[22] Filed: June 25, 1973

[21] Appl. No.: 372,907

[52] U.S. Cl. ..... 273/73 D

[51] Int. Cl.[2] ..... A63B 51/02

[58] Field of Search ..... 273/73 R, 73 C, 73 D, 273/73 E, 73 G, 73 H, 73 L, 73 A, 96 D

[56] References Cited

UNITED STATES PATENTS

| | | | |
|---|---|---|---|
| 2,666,641 | 1/1954 | Bonham | 273/73 D UX |
| 2,884,249 | 4/1959 | Cunningham | 273/73 D UX |
| 2,969,984 | 1/1961 | Presnick | 273/73 L X |
| 3,206,203 | 9/1965 | Lacoste | 273/73 H |
| 3,507,494 | 4/1970 | Finkel | 273/73 D X |
| 3,630,523 | 12/1971 | Lacoste | 273/73 D |
| 3,647,211 | 3/1972 | Doessel et al. | 273/73 D X |
| 3,702,702 | 11/1972 | Hoult | 273/96 D |
| 3,711,092 | 1/1973 | Hogue | 273/73 D X |
| 3,734,499 | 5/1973 | Goldstein | 273/73 R X |
| 3,751,034 | 8/1973 | Portz et al. | 273/73 D |

FOREIGN PATENTS OR APPLICATIONS

| | | | |
|---|---|---|---|
| 237,395 | 7/1925 | United Kingdom | 273/73 D |
| 252,990 | 7/1964 | Australia | 273/73 D |
| 253,694 | 8/1964 | Australia | 273/73 H |
| 1,495,578 | 8/1967 | France | 273/73 D |
| 1,043,897 | 11/1958 | Germany | 273/73 D |
| 1,089,675 | 9/1960 | Germany | 273/73 C |
| 28,838 | 12/1902 | United Kingdom | 273/73 E |
| 14,147 | 11/1885 | United Kingdom | 273/73 H |
| 204,113 | 9/1923 | United Kingdom | 273/73 L |

*Primary Examiner*—Richard J. Apley

[57] ABSTRACT

A string system for rapidly stringing game racket frames ultilizing an improved string suspension system consisting of a plurality of openly accessible string support elements coacting with and spaced around the inner circumference of the racket frame and a prewoven net consisting of a plurality of interwoven longitudinal and latitudinal runs of strings, wherein the longitudinal and latitudinal strings, respectively, upon completing a run of predetermined length, each form a loop and begin another run of predetermined length in the opposite but predominantly parallel direction to and spaced apart from the preceeding run. This is continued with both the longitudinal and latitudinal strings, alternately interweaving the longitudinal and latitudinal strings until a woven net of predetermined size and shape is achieved with respect to the game racket frame to be strung. The loops of the prewoven net are attached to and supported by corresponding openly accessible string support elements of the string suspension system thereby combining the stringing and tensioning operations.

1 Claim, 40 Drawing Figures

STRING SYSTEM FOR A GAME RACKET

CROSS-REFERENCE TO RELATED APPLICATIONS

See filed patent application by Roger D. Pass, "Tennis-Rackets and the Like," Ser. No. 155,830, filing date June 23, 1971 and now U.S. Pat. No. 3,834,699.

BACKGROUND OF THE INVENTION

1. Field of the Invention

Class 273, subclass 73. Amusement devices, games; Bats, mallets, racquetes, cues, pins and billies; Tennis.

2. Description of the Prior Art

In general, game rackets comprise, in combination, a frame, shaft, handle, a string suspension system and a resilient net of strings. In a conventional racket frame, the string support elements, which comprise the string suspension system, are of such a nature that a free end of the strings must be located, threaded into, through and around the string support element and the longitudinal and the latitudinal strings must be interwoven within the frame manually thus making it difficult and time consuming to string a racket frame and therefore less economical for U.S.A. manufacturers to compete with foreign countries utilizing cheaper labor.

SUMMARY OF THE INVENTION

It is the object of this invention to provide an improved method of stringing game rackets that is fast, accurate, reliable and lends itself to nearly automatic techniques and to provide for this improved method of stringing game rackets by providing a coacting combination of specific and related improvements in certain components of a game racket. These improved components consist of, in part, a novel prewoven net of strings and improved string suspension systems. The prewoven net is woven independently of the frame before the strings are introduced within the frame and consists of a plurality of interwoven longitudinal and latitudinal runs of strings, wherein the longitudinal and latitudinal strings, respectively, upon completing a run of predetermined length, each form a loop and begin another run of predetermined length in the opposite but predominantly parallel direction to and spaced apart from the preceeding run. This process is continued preferably consecutively with both the longitudinal and latitudinal strings, alternately interweaving the longitudinal and latitudinal strings at their cross over points until a woven net of predetermined size and shape is achieved with respect to the game racket frame to be strung. The ends of the longitudinal and latitudinal strings, respectively, can each be attached to an adjacent parallel run of string thereby forming a terminated loop. The string suspension system consists of a plurality of openly accessible string support elements coacting with and spaced around the inner circumference of the racket frame and are openly accessible in such a fashion that the respective loops, including the terminated loops, of the prewoven net may be passed in engagement with corresponding openly accessible string support elements while the openly accessible string support elements are in a coacting relationship with the racket frame. The positions, size and spacings of the openly accessible string support elements are accurately predetermined with respect to the proper positions the strings are to assume in the racket frame.

In one embodiment, a game racket is provided having a frame, shaft and handle wherein the frame has openly accessible string support elements, which comprise the string suspension system, consisting of a plurality of elongated C shaped slots formed into and spaced around the inner circumference of the racket frame. A prewoven net is provided of such size and shape in relation to the racket frame that the prewoven net can be accurately tensioned within said racket frame by attaching the loops of the prewoven net onto corresponding tabs formed by the elongated C shaped slots.

It is a further advantage of this invention that the amount of string tension can be controlled by simply varying the length of the strings in the prewoven set, or by varying the length of the openly accessible string support elements.

It is a further object of this invention to accomplish the preceeding objects while maintaining a game racket that has a sensitive touch and a firm responsive feel for greater power, accuracy and control.

DESCRIPTION OF THE PREFERRED EMBODIMENTS

Figure 36:
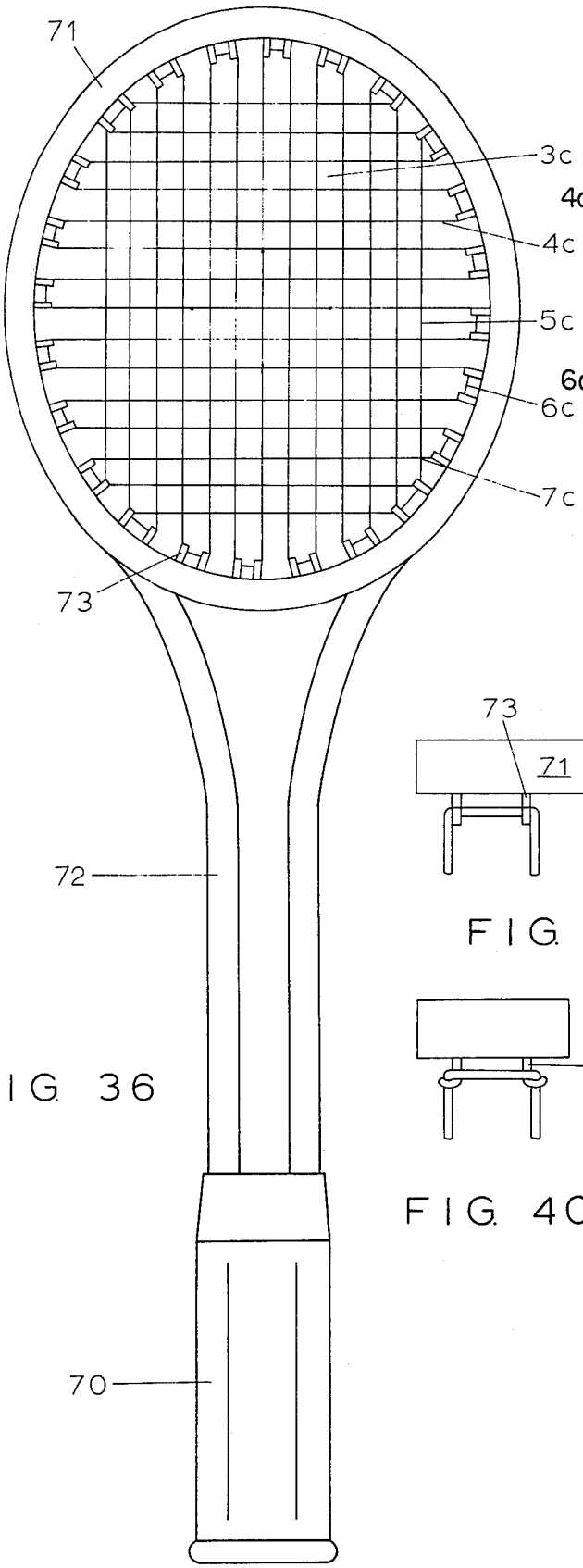
FIG. 36 is a rear view of a game racket showing the frame, shaft, handle, string suspension system and a prewoven net.

A game racket, as defined by the inventor, comprises a frame, shaft, handle, net of strings and a string suspension system. The frame is that portion of the game racket which incorporates the string suspension system which in turn secures the net of strings in relationship to the frame. The net of strings is that portion of the game racket consisting of strings which lie tensioned within the frame and are arranged into a resilient net which consists of a plurality of longitudinal spaced apart runs of strings and a plurality of latitudinal spaced apart runs of strings. The longitudinal and latitudinal strings may or may not be interwoven as described in detail in my patent application entitled, "Tennis-Rackets and the Like". The longitudinal and latitudinal strings may be single strand or may consist of many strands twisted together. As the invention is concerned mainly with certain modifications involving the frame, the string suspension system, the net of strings and various advantages derived therefrom, the drawings mainly exhibit the improved portion itself (i.e., the frame, the net of strings and the string suspension system), disconnected from the old structure (i.e., the shaft and handle). However, in some drawings, a portion of the shaft, in relationship to the frame, is shown to illustrate the connection of the old structure with the invention. Although the handle is not shown in most drawings it can be construed to be at the end of the shaft opposite the frame as shown in FIG. 36.

FIGS. 1, 7, 19 and 36 illustrate a number of prewoven nets in coacting relationships with appropriate string suspension systems and racket frames. FIGS. 2, 8, 20 and 37 illustrate, respectively, more detailed views of said prewoven nets. A prewoven net, by definition, is woven disjunctively from the frame by hand or by automatic weaving techniques and, in general, consists of a plurality of longitudinal spaced apart parallel runs of strings each of predetermined length alternately interwoven with a plurality of latitudinal spaced apart parallel runs of strings each of predetermined length. The longitudinal and latitudinal runs of strings, respectively, are each preferrably formed from one length of string. A string upon completing a run of predetermined length forms a loop and begins another run of predetermined length in the opposite but predominently parallel direction to and spaced apart from the preceeding run. This process is continued with both the longitudinal and latitudinal strings, alternately interweaving the longitudinal and latitudinal strings at their cross over points until a woven net of predetermined size and shape is achieved with respect to the size and shape of the frame to be strung, the ends of the longitudinal and latitudinal strings, respectively, each being attached to an adjacent parallel run of string thereby forming a terminated loop. The exact size and configuration of a prewoven net is achieved by making each and every longitudinal and latitudinal run of string a predetermined length. While FIGS. 1, 7, 19 and 36 show the frame as being generally elliptical shaped, the frame could also be round, rectangular or some other configuration, in which case, the prewoven net would be woven in a size and configuration to allow its accurate tensioning within the particular frame. The size of the prewoven net will usually be slightly smaller than that apparently needed, to allow for the elasticity and consequent elongation of the strings, so that the prewoven net may be accurately tensioned within the frame to be strung. The overall tension of the prewoven net is in direct proportion to the overall size of the prewoven net in relationship to the frame and the tension may be increased or decreased by decreasing or increasing the overall size of the prewoven net respectively, or by increasing or decreasing the overall size of the frame respectively.

The simultaneous stringing and tensioning of the prewoven net within the racket frame essentially follows a basic pattern of attaching the loops of the prewoven net onto corresponding openly accessible string support elements while the openly accessible string support elements are in coacting relationship with the frame. This can be accomplished in a number of alternate ways. The loops of the prewoven net could be attached to the corresponding openly accessible string support elements singly — one at a time, in unison — all at once, or the loops of the prewoven net could first be attached to corresponding openly accessible string support elements at one side of the frame and then to the opposite side of the frame followed by one end of the frame and then the opposite end of the frame, or one side and one end of the frame followed by the opposite side and end of the frame. It may be necessary to clamp or bond the longitudinal and latitudinal runs of strings of the prewoven net together, respectively, before tensioning within the frame to prevent slipping.

Thus, as the loops of the prewoven net are attached to or passed in engagement with the corresponding openly accessible string support elements the prewoven net is simultaneously tensioned within the frame.

Figure 1:
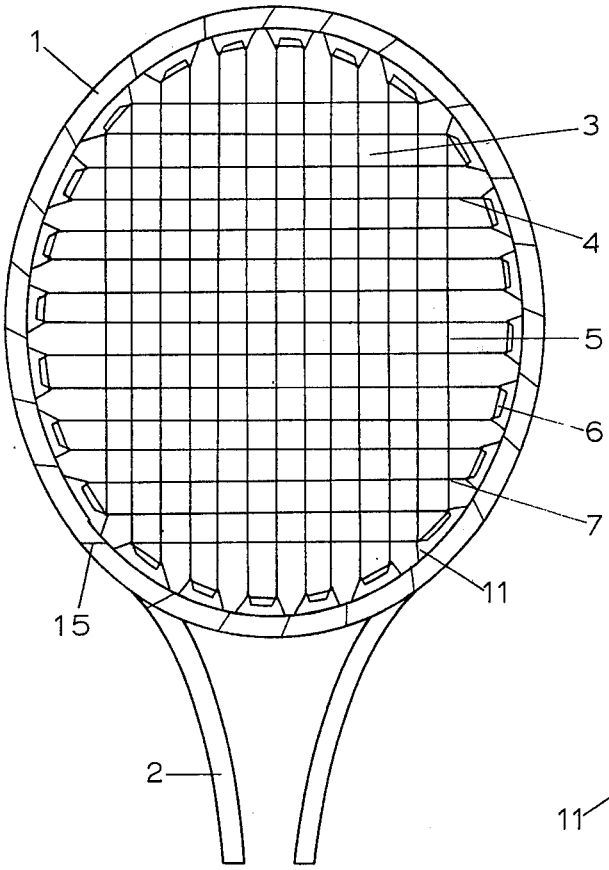
FIG. 1 is a front view of a game racket showing the frame, shaft portion, string suspension system and a prewoven net.

Shown in FIG. 1 is the frame 1 and shaft portion 2 of a game racket. Held in tension within the frame by means of a string suspension system consisting of the serrated annular wire 11 and the coiled wire 15 is the prewoven net 3, a more detailed view of which is shown in FIG. 2.

The prewoven net, as earlier described, consists of a plurality of longitudinal and latitudinal runs of strings, such as longitudinal and latitudinal runs of strings, 5 and 4 respectively, alternately interwoven at their cross over points, such as cross over point 7, and a plurality of loops, such as loop 6. The ends of the longitudinal and latitudinal runs of strings, such as end 8, are shown attached to an adjacent parallel run, such as adjacent parallel run 4', each end thereby forming terminated loops, such as terminated loop 6'.

Figure 5:
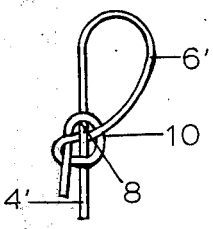
FIG. 5 demonstrates one method of forming a terminated loop of a prewoven net.

FIG. 5 shows the terminated loop 6' in more detail, the end 8 being attached to the adjacent parallel run 4' by the knot 10. The ends of the longitudinal and latitudinal runs of strings could also be attached to an adjacent parallel run of string by bonding or by a tight fitting sleeve or they could be left free and secured, at the time of tensioning, to a string support element or to the racket frame.

Figure 2:
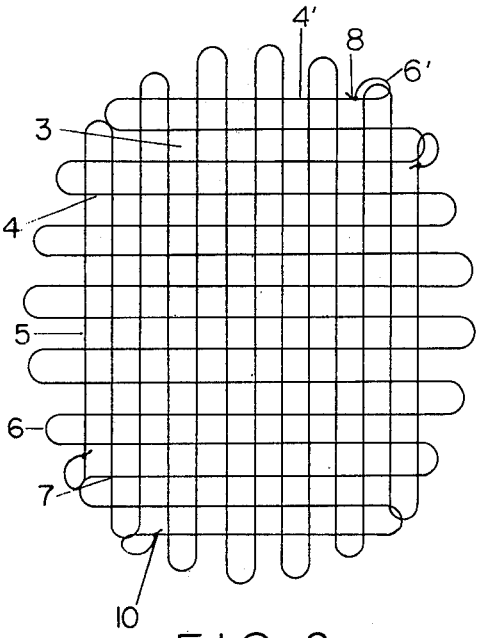
FIG. 2 is a front view showing in more detail the prewoven net of FIG. 1.
Figure 4:
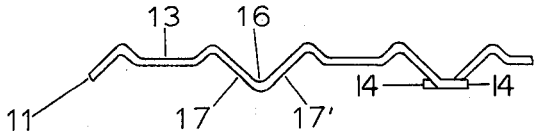
FIG. 4 is a developed view of a portion of the string suspension system of FIG. 1.
Figure 3:
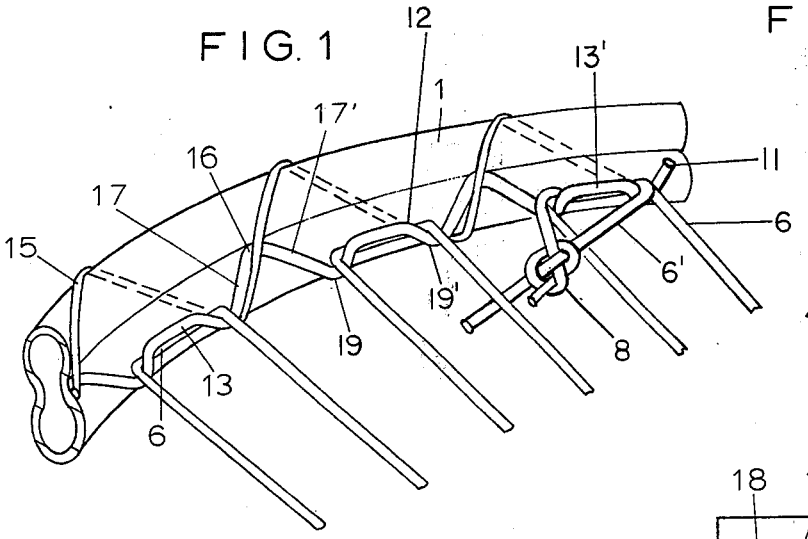
FIG. 3 is a perspective view showing a portion of the racket frame and string suspension system of FIG. 1 and a means of mounting said string suspension system within said frame.

FIG. 3 illustrates in more detail a portion of the string suspension system of FIG. 1 coacting in conjunction with a portion of the prewoven net 3, shown in FIG. 2, and with a portion of the frame 1. FIG. 4 shows a portion of the serrated annular wire 11. The serrated annular wire 11 substantially conforms in general contour with the inner circumference of the racket frame and is formed with a plurality of spaced apart openly accessible string support elements consisting of M-shaped hooks, such as M-shaped hook 13 having a generally M-shaped contour. The legs 17 and 17' forming the outside legs of the "M" and the connecting portion being indented towards the frame defines two apices 19 and 19' adjoining the legs 17 and 17' thereby completing the configuration of the M-shaped hooks. The indented portion 12 serves to retain a loop of string which is seated around the two apices 19 and 19' as shown. The serrated annular wire 11 is closed by simply bringing its ends such as ends 14 and 14', as shown in FIG. 4, into coincidence. The serrated annular wire 11 is secured to the racket frame 1 by turns of the coiled wire 15 passing over the top base portions, such as top base portion 16 of the legs, such as legs 17 and 17', of the M-shaped hooks and around the racket frame 1. The length of the spacings between the M-shaped hooks and the length of the indented connecting portions of the M-shaped hooks are varied along the inner circumference of the frame in accordance with the requisite spacing of the strings in each part of the frame. In stringing and tensioning the prewoven net within the frame, the loops of the prewoven net are passed in engagement with corresponding M-shaped hooks, as shown, thereby quickly and accurately tensioning the prewoven net within the frame. FIG. 3 also shows a M-shaped hook 13' in coaction with a terminated loop 6' and a conventional loop 6.

Figure 6:
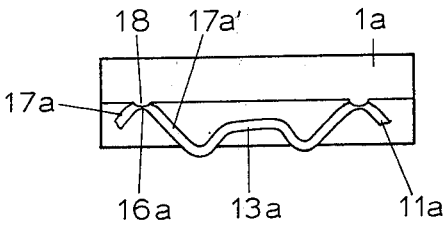
FIG. 6 shows a portion of the racket frame and string suspension system of FIG. 1 illustrating an alternate means of mounting said string suspension system within said frame.

FIG. 6 shows an alternate way of attaching a serrated annular wire **11*a* onto a frame 1*a* by welding the base portions, such as base portion 16*a*, of the legs, such as legs 17*a* and 17*a'*, of the M-shaped hooks, such as M-shaped hook 13*a*, to the frame 1a by welds, such as the weld 18**.

Figure 7:
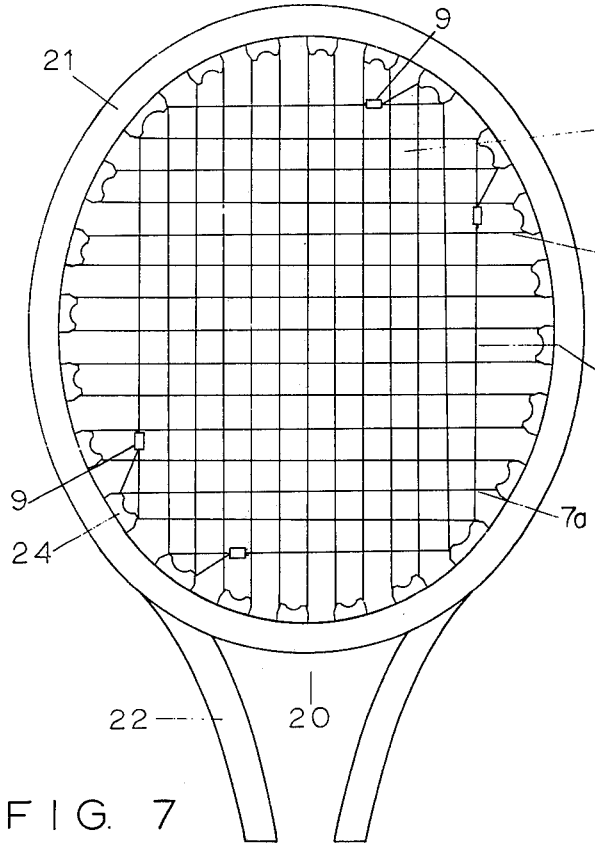
FIG. 7 is a rear view of a game racket showing the frame, shaft portion, string suspension system and a prewoven net.
Figure 8:
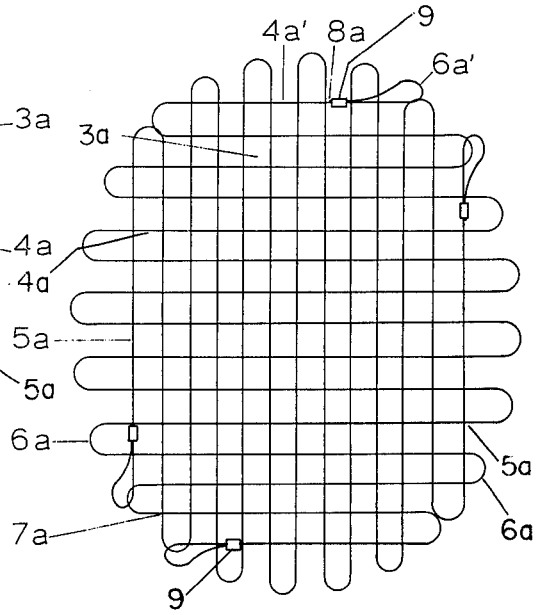
FIG. 8 is a rear view showing in more detail the prewoven net of FIG. 7.

FIGS. 9, 10 and 11, 12 and 13, 14, 15, 16, 17 and 18 illustrate, in part, detailed portional views of alternate string suspension systems, which when coacting in conjunction with a prewoven net, such as prewoven net **3*a* shown in FIGS. 7 and 8, and with a racket frame having an appropriate cross sectional configuration achieves a game racket with an outward appearance similar to that portion of the game racket 20 of FIG. 7, showing the frame 21, a portion of the shaft 22 and the openly accessible string support elements 24**.

The prewoven net, as earlier described, consists of a plurality of longitudinal and latitudinal runs of strings, such as longitudinal and latitudinal runs of strings **5*a* and 4*a* respectively, alternately interwoven at their cross over points, such as cross over point 7*a*, and a plurality of loops, such as loop 6*a*. The ends of the longitudinal and latitudinal runs of strings, such as end 8*a*, are shown attached to an adjacent parallel run, such as adjacent parallel run 4*a'*, each end thereby forming terminated loops, such as terminated loop 6*a'***.

Figure 9:
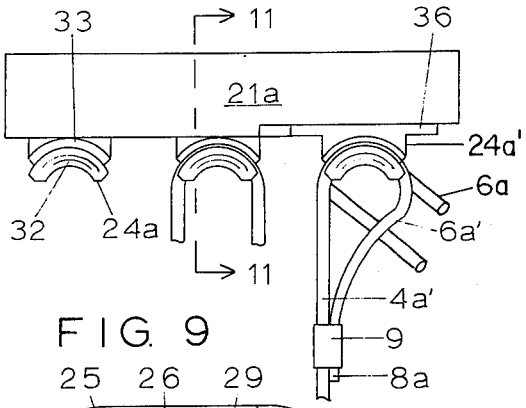
FIGS. 9, 12 and 14 show a developed front view of a portion of the game racket and string suspension system of FIG. 7.

FIG. 9, in part, shows terminated loop **6*a'* and loop 6*a* supported together on hanger 24*a'* in more detail. The end 8*a* of loop 6*a'* is attached to the adjacent parallel run 4*a'* by the tight fitting sleeve 9**.

Figure 10:
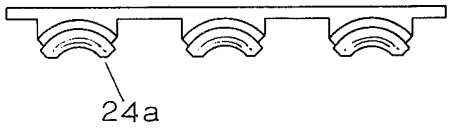
FIG. 10 is a developed front view of a group of openly accessible string support elements formed as a unitary structure.
Figure 11:
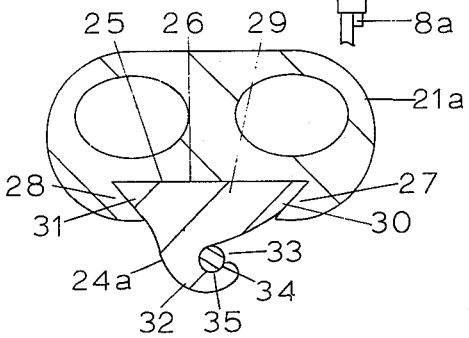
FIG. 11 is a cross sectional view taken through section 11—11 of FIG. 9.

FIGS. 9, 10 and 11 exemplify a racket frame having a cross sectional configuration similar to frame **21*a*, consisting of an inside channel 25 formed by the inside wall 26, the upper flange 27 and the lower flange 28, and having a plurality of openly accessible string support elements, which comprise the string suspension system, consisting of hangers, such as hanger 24*a*, having a base portion 29 including an upper shoulder 30 and a lower shoulder 31 and a transversely extending generally U-shaped hanger portion 32 having a C-shaped groove 33 the inner circumference 34 of which is depressed along its length to provide a seat 35 for the respective loops of the prewoven net. The hangers lie within said channel and are secured therein by the upper flange and the lower flange of the frame acting in opposition to the upper shoulder and the lower shoulder of the hangers, respectively. The hangers essentially fill the inner circumference of the frame either singly with spacer projections 36 as shown in FIG. 9 or as a unified structure, a part of which is shown in FIG. 10. The length of the spacings between the hangers and the length of the hangers themselves, are varied along the circumference of the frame in accordance with the requisite spacing of the strings of the prewoven net in each part of the frame. In stringing and tensioning the prewoven net within the frame, the loops of the prewoven net are passed in engagement with the C-shaped grooves of corresponding hangers as shown in FIG. 9**.

Figure 12:
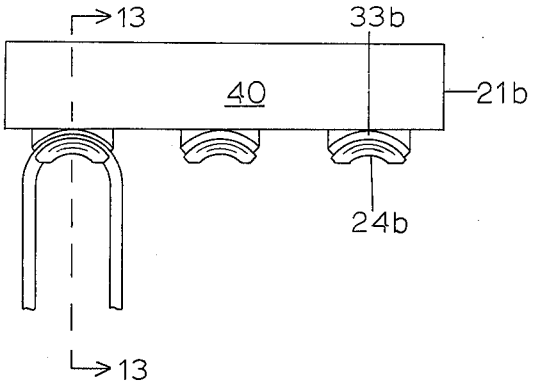
Figure 13:
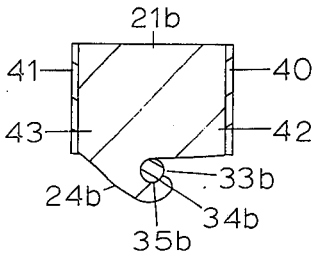
FIG. 13 is a cross sectional view taken through section 13—13 of FIG. 12.

FIGS. 12 and 13 exemplify a racket frame having a cross sectional configuration similar to frame **21*b* and openly accessible string support elements, which comprise the string suspension system, consisting of a plurality of hangers, such as hanger 24*b*, having C-shaped grooves, such as C-shaped groove 33*b*, said hangers formed as an integral part of and spaced around the inner circumference of the frame. The inner circumference 34*b* of the C-shaped grooves are depressed slightly along its length to provide a seat 35*b* for the respective loops of the prewoven net. The length of the spacings between the hangers and the length oof the hangers themselves, are varied along the inner circumference of the frame in accordance with the requisite spacing of the strings of the prewoven net in each part of the frame. In stringing and tensioning the prewoven net within the frame, the loops of the prewoven net are passed in engagement with the C-shaped grooves of corresponding hangers as shown. An upper veneer 40 and a lower veneer 41 are shown adhered to the upper and lower sides 42 and 43, respectively, of the frame 21***b* to increase the longitudinal stability of said frame.

Figure 14:
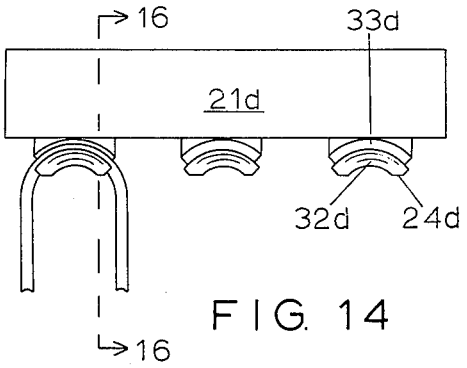
Figure 15:
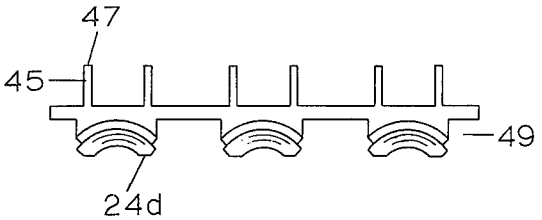
FIG. 15 is a more detailed developed front view of the openly accessible string support elements of FIG. 14.
Figure 16:
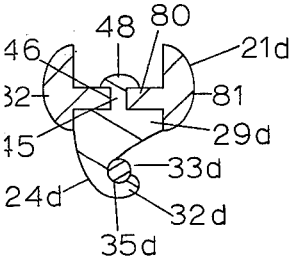
FIGS. 16, 17 and 18 illustrate alternate cross sectional views as they would appear taken through 16—16 of FIG. 14.

FIGS. 14, 15 and 16 exemplify, in part, a racket frame having a string suspension system, which is adaptable to all conventional racket frames, such as frame 21*d* having a web portion 80 separating and connecting the upper flange 81 from the lower flange 82, which utilize a string suspension system consisting of spaced stringing holes, such as stringing hole 46, extending transversely through the frame with little or no modification to the frame. A series of openly accessible string support elements, such as hanger 24*d*, are contiguous to and spaced around the inner circumference of the frame 21*d*, the positions of which are accurately predetermined with regard to the proper positions the strings of the prewoven net are to assume in the frame. The hangers include a base portion 29*d* and transversely extending inwardly, a generally U-shaped hanger portion 32*d* having a C-shaped groove 33*d* the inner circumference, of which, is depressed slightly along its length to provide a seat 35*d* for the respective loops of the prewoven net. Projecting outwardly from said base portion are cylindrical shaped projections, such as cylindrical shaped projection 45, of a number, size and alignment so as to be readily insertable and extendable through said existing stringing holes in a conventional racket frame. Once inserted, the tops, such as top 47, of said cylindrical shaped projections are provided with a cap 48 thereby securing said hangers within said frame. The hangers may be formed separately, as shown in FIG. 16 or as parts of a unified structure 49 as shown in FIG. 15 which could be expanded to occupy the entire inner circumference of the frame. The length of the spacings between the hangers and the length of the hangers themselves, are varied along the circumference of the frame in accordance with the requisite spacing of the strings of the prewoven net in each part of the frame. In stringing and tensioning the prewoven net within the frame, the loops of the prewoven net are passed in engagement with said C-shaped grooves of corresponding hangers as shown.

Figure 17:
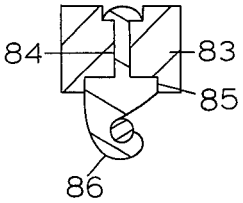
Figure 18:
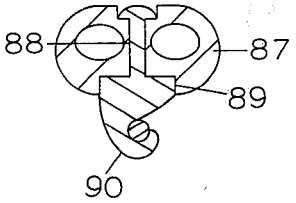

FIGS. 17 and 18 illustrate, in part, alternate conventional racket frame cross sectional configurations that could also be utilized with the string suspension system of FIG. 15.

FIG. 17 exemplifies, in part, a racket frame, such as frame 83, having essentially a solid cross sectional configuration and having a plurality of spaced stringing holes extending transversely through the frame, such as stringing hole 84. The longitudinal groove 85 exemplifies a longitudinal groove formed into and running the length of the inner circumference of the frame and providing lateral stability to the openly accessible string support elements, such as hanger 86.

FIG. 18 exemplifies, in part, a racket frame, such as frame 87, being of a hollow extrusion and having a plurality of spaced stringing holes extending transversely through the frame, such as stringing hole 88. The longitudinal groove 89 exemplifies a plurality of longitudinal grooves formed into and running intermittantly the length of the inner circumference of the frame and providing lateral stability to the openly accessible string support elements, such as hanger 90.

Figure 19:
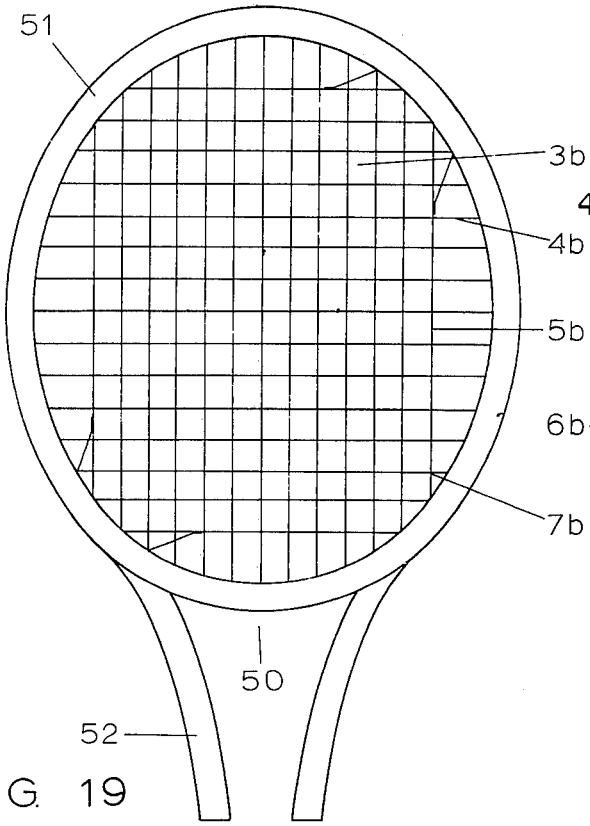
FIG. 19 is a rear view of a game racket showing the frame, shaft portion and prewoven net.
Figure 20:
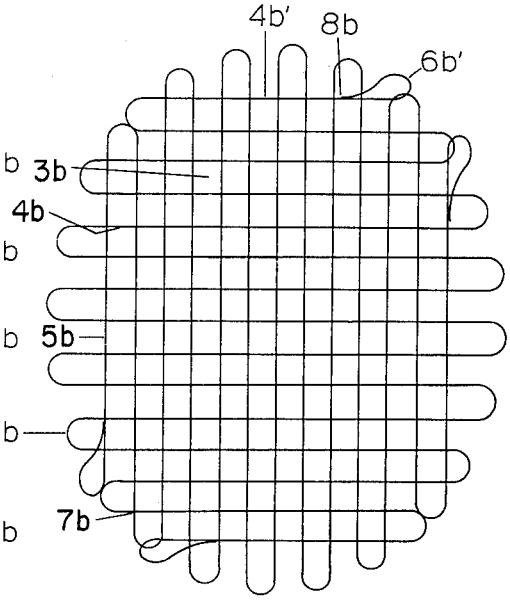
FIG. 20 is a rear view showing in more detail the prewoven net of FIG. 19.

FIGS. 21, 22 and 23, 24 and 25, 26, 27, 28 and 29, 30, 31 and 32, 30 and 33, and 34 and 35 illustrate, in part; various alternate string suspension systems, which when coacting in conjunction with a prewoven net, such as prewoven net 3*b* shown in FIGS. 19 and 20, and with a racket frame having an appropriate cross sectional configuration achieves a game racket with an outward appearence similar to that portion of the game racket 30 of FIG. 19, showing the frame 51, and a portion of the shaft 52.

The prewoven net, as earlier described, consists of a plurality of longitudinal and latitudinal runs of strings, such as longitudinal and latitudinal runs of strings 5*b* and 4*b* respectively, alternately interwoven at their cross over points, such as cross over point 7*b*, and a plurality of loops, such as loop 6*b*. The ends of the longitudinal and latitudinal runs of strings, such as end 8*b*, are shown attached to an adjacent parallel run, such as adjacent parallel run 4*b*′, each end thereby forming terminated loops, such as terminated loop 6*b*′.

Figure 23:
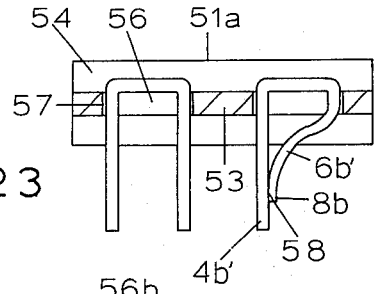
FIG. 23 is a developed cross sectional view taken through section 23—23 of FIG. 22.

FIG. 23, in part, shows the terminated loop 6*b*′ in more detail, the end 8*b* being attached to the adjacent parallel run 4*b*′ by bonding, as by the bond 58.

Figure 21:
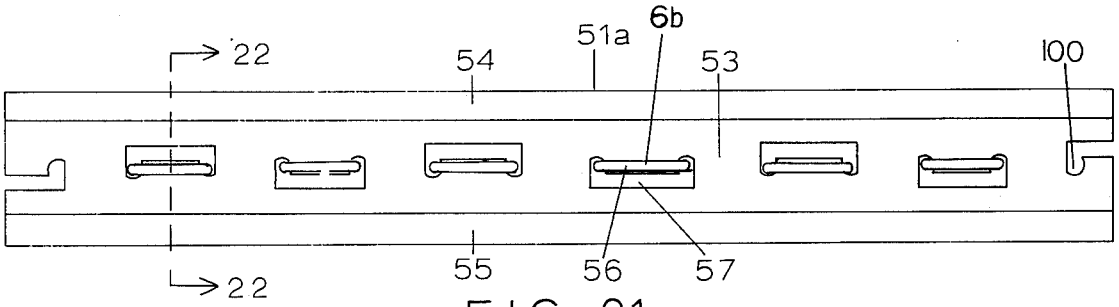
FIG. 21 is an outside side view of the frame of FIG. 19 illustrating an alternate embodiment of a string suspension system.
Figure 22:
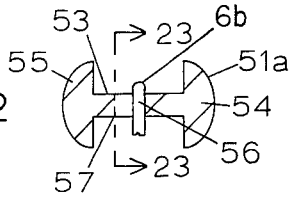
FIGS. 22 and 24 illustrate alternate cross sectional views as they would appear as taken through 22—22 of FIG. 21.

FIGS. 21, 22 and 23 exemplify, in part, a frame having a cross sectional configuration similar to frame 51*a*. The frame 51*a* has a web portion 53 separating and connecting the upper flange 54 from the lower flange 55. A plurality of openly accessible string support elements, which comprise the string suspension system are provided consisting of a plurality of disconnected elongated C-shaped slots 57, each forming by its shape tabs 56 and circular indentations 100, formed into and spaced around the web portion of the frame. The length of the spacings between the tabs and the length of the tabs themselves are varied along the inner circumference of the frame in accordance with the requisite spacing of the strings in each part of the frame. In stringing and tensioning the prewoven net within the frame, the loops of the prewoven net, such as loop 6*b*, are inserted in corresponding C-shaped slots and passed in engagement with corresponding tabs, such as tab 56, so that the loops are supported by the tabs and held in position on the tabs by lying within the circular indentation, such as circular indentation 100, located on both ends of the tabs. The directions in which the C-shaped slots are faced is alternated for better distribution of stress and the tabs are substantially in a plane coplanar with the net of strings within the frame.

Figure 24:
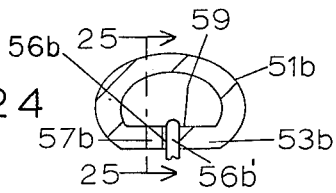
Figure 25:
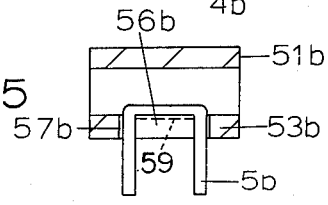
FIG. 25 is a developed cross sectional view taken through section 25—25 of FIG. 24.

FIGS. 24 and 25 exemplify a racket frame having a similar appearence as seen from the inside side to FIG. 21 and a similar string suspension system as FIG. 21 but having an alternate racket frame cross sectional configuration similar to frame 51*b*. A plurality of openly accessible string support elements, which comprise the string suspension system, are provided consisting of a plurality of disconnected elongated C-shaped slots, such as C-shaped slot 57*b*, are formed into and spaced around the inside wall 53*b*, which forms the inner circumference of the generally elliptical frame. The tabs, such as tab 56*b*, formed by respective elongated C-shaped slots, are provided with longitudinal depressions, such as longitudinal depression 59, thereby providing a seat for the respective loops, such as loop 56*b*′, of the prewoven net. The frame is strung in the same manner as the frame of FIGS. 21, 22 and 23. FIG. 25 shows the string 5*b* passing in engagement with the tab 56*b* of the C-shaped slot 57*b*.

FIGS. 26, 27, 28 and 29 exemplify a game racket frame having a tubular cross sectional configuration similar to frame 51*c* and a string suspension system that is particularly suitable for use with and is an integral part of the tubular racket frame. The openly accessible string support elements, which comprise the string suspension system, consists of a plurality of interconnected elongated C-shaped slots, such as C-shaped slot 57*c*, formed into and spaced around the length of the inner circumference of the frame thereby forming a continuous longitudinal slot, a portion of which is exemplified by the longitudinal slot 60, running the length of the inner circumference of the frame. The interconnected elongated C-shaped slots may be formed as part of either the upper or lower or both upper and lower portions, such as upper and lower portions 61 and 62 respectively, of the continuous longitudinal slot. The length of the tabs, such as tab 63, formed by the C-shaped slots and the length of the spacings between the tabs are varied along the inner circumference of the frame in accordance with the requisite spacing of the strings in each part of the frame. In stringing and tensioning the prewoven net within the frame, the loops of the prewoven net are passed in engagement with the corresponding tabs of respective C-shaped slots, as shown.

Figure 26:
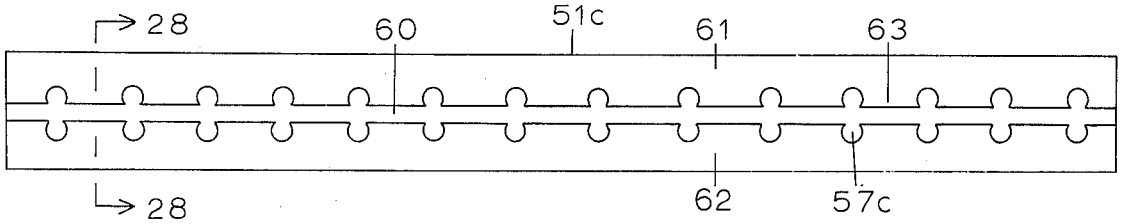
FIG. 26 is an inside side view of FIG. 19 illustrating another alternate embodiment of a string suspension system.
Figure 27:
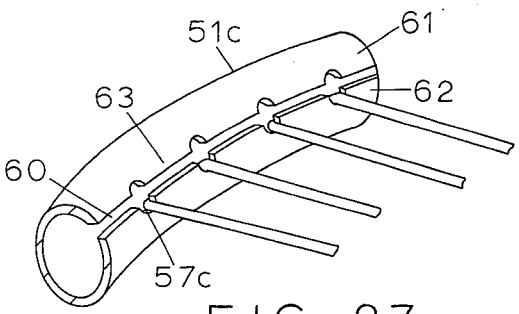
FIG. 27 is a perspective view of a portion of FIG. 26.
Figure 28:
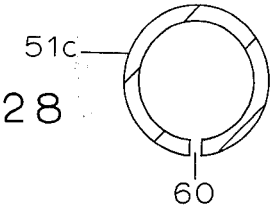
FIGS. 28 and 29 illustrate alternate cross sectional views as they would appear as taken through 28—28 of FIG. 26.
Figure 29:
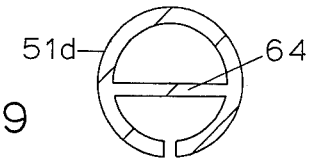

FIG. 29 is an alternate cross sectional view of FIG. 26 showing the tubular frame 51*d* and differing from FIG. 28 by the internal web portion 64 which acts to strengthen the frame.

Figure 30:
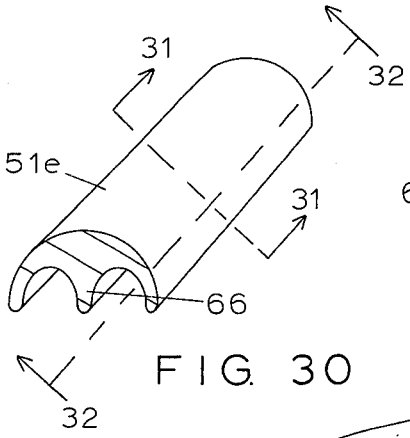
FIG. 30 is a developed oblique view illustrating an additional alternate embodiment of a portion of the frame of FIG. 19.
Figure 31:
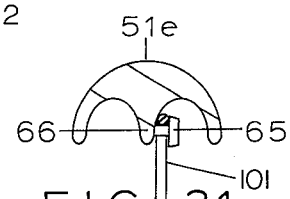
FIG. 31 is a cross sectional view taken through section 31—31 of FIG. 30.
Figure 32:
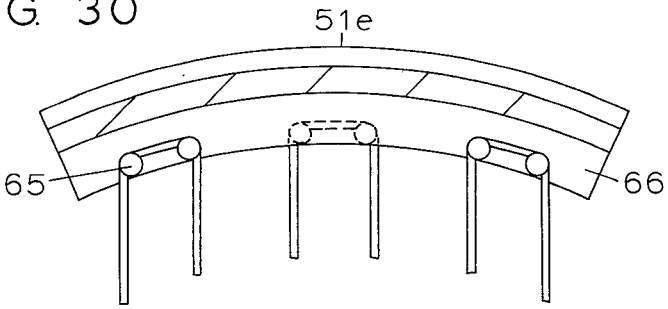
FIG. 32 is a cross sectional view taken through section 32—32 of FIG. 30.

FIGS. 30, 31 and 32 exemplify, in part, a game racket frame having a T-shaped cross sectional configuration similar to frame 51*e*. The openly accessible string support elements, which comprise the string suspension system, consists of a plurality of pegs, such as peg 65, attached to and spaced around the leg, a portion of which is exemplified by the leg 66, said leg forming part of the inner circumference of the frame. The length of the spacings between the pegs are varied along the inner circumference of the frame in accordance with the requisite spacings of the runs of strings of the prewoven net in each part of the frame. In stringing and tensioning the prewoven net within the frame, the loops of the prewoven net are passed in engagement with two adjacent and corresponding pegs, as shown, the pegs extending at a right or slightly an acute angle to the plane of the frame so that the loops of the prewoven net will not slip accidentally off the pegs. FIG. 31 shows the peg 65 supporting the string 101. In FIG. 32 the pegs alternate on opposite sides of leg 66 for better distribution of stress.

Figure 33:
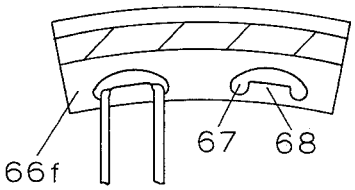
FIG. 33 illustrates an alternate cross sectional view as it would appear as taken through section 32—32 of FIG. 30.

FIG. 33 exemplifies, in part, a game racket frame having a similar T-shaped cross sectional configuration as shown in FIG. 30. The openly accessible string support elements, which comprise the string suspension system, consists of a plurality of disconnected elongated C-shaped slots, such as C-shaped slot 67, formed into and spaced around the leg, a portion of which is exemplified by the leg 66*f*, said leg forming part of the inner circumference of the frame. The length of the spacings between the tabs, such as tab 68, formed by the elongated C-shaped slots and the length of the tabs, themselves, are varied along the inner circumference of the frame in accordance with the requisite spacing of the strings in each part of the frame. In stringing and tensioning the prewoven net within the frame, the loops of the prewoven net are passed in engagement with the respective tabs of corresponding C-shaped slots, as shown.

Figure 34:
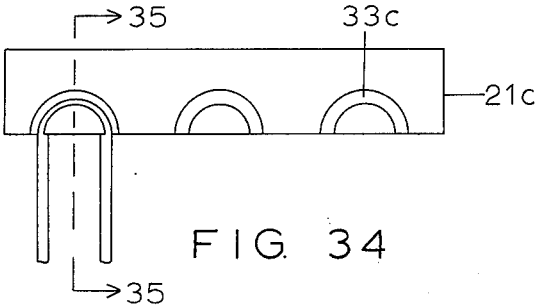
FIG. 34 is a developed front view illustrating an additional alternate embodiment of a portion of the frame of FIG. 19.
Figure 35:
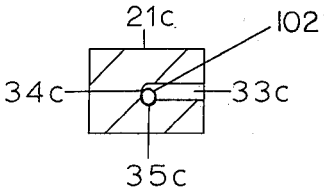
FIG. 35 is a cross sectional view taken through section 35—35 of FIG. 34.

FIGS. 34 and 35 exemplify a game racket frame having a cross sectional configuration similar to frame 21*c* and a plurality of openly accessible string support elements, which comprise the string suspension system, consisting of a plurality of C-shaped grooves, such as C-shaped groove 33*c*, formed within and as an integral part of the frame and spaced around the inner circumference of the frame. The inner circumference 34*c* of the C-shaped grooves are depressed slightly along its length to provide a seat 35c for the loops of the prewoven net. The length of the spacings between the C-shaped grooves and the length of the C-shaped grooves themselves, are varied along the circumference of the frame in accordance with the requisite spacing of the strings of the prewoven net in each part of the frame. In stringing and tensioning the prewoven net within the frame, the respective loops of the prewoven net are passed in engagement with corresponding C-shaped grooves, as shown. The C-shaped groove 33*c* is similar to the C-shaped grooves of the hangers of FIGS. 9 through 18. FIG. 35 shows the string 102 lying within the seat 35*c*.

Figure 37:
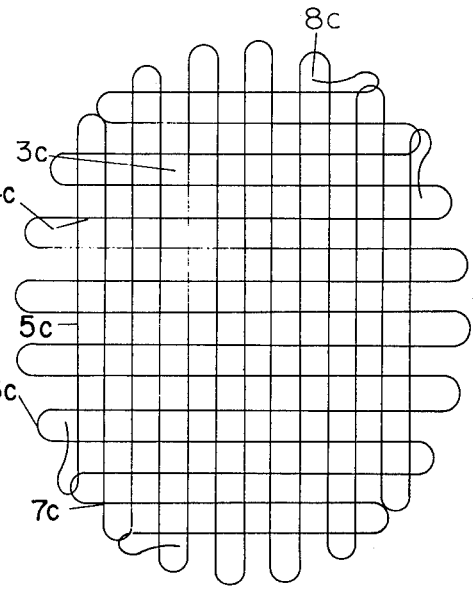
FIG. 37 is a rear view showing in more detail the prewoven net of FIG. 36.
Figure 38:
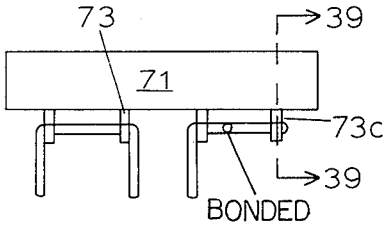
FIG. 38 is a developed front view illustrating a portion of the racket frame of FIG. 36.
Figure 39:
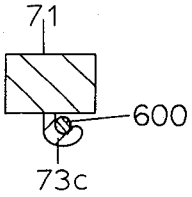
FIG. 39 is a cross sectional view taken through section 39—39 of FIG. 38.

Shown in FIG. 36 is the frame 71, shaft 72 and handle 70 of a game racket. Held in tension within the frame by means of a plurality of openly accessible string support elements, which comprise the string suspension system, consisting of a plurality of inwardly and laterally extending hooks, such as hook 73, a more detailed view of which is shown in FIGS. 38 and 39, attached to and spaced around the inner circumference of the frame, is the prewoven net 3*c*, a more detailed view of which is shown in FIG. 37. The prewoven net, as earlier described, consists of a plurality of longitudinal and latitudinal runs of strings, such as longitudinal and latitudinal runs of strings 5c and 4c respectively, alternately interwoven at their cross over points, such as cross over point 7*c*, and a plurality of loops, such as loop 6*c*. The ends of the longitudinal and latitudinal runs of strings, such as end 8*c*, could be left free (FIG. 37) and attached at the time the prewoven net is tensioned within the frame to an openly accessible string support element, such as the hook 73*c* (FIG. 38), by a knot or bond. The length of the spacings between the hooks are varied along the circumference of the frame in accordance with the requisite spacings of the runs of strings of the prewoven net in each part of the frame. In stringing and tensioning the prewoven net within the frame, the loops of the prewoven net are passed in engagement with two adjacent and corresponding hooks, as shown.

Figure 40:
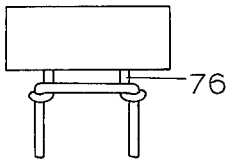
FIG. 40 illustrates an alternate embodiment of FIG. 38.

FIG. 40 exemplifies an alternate string suspension system similar in all respects to the string suspension system of FIGS. 36 and 38 except that the plurality of hooks, such as hook 76, extend inwardly and longitudinally, as shown, thereby subjecting the loops of the prewoven net to a more gradual bend than the inwardly and laterally extending hooks of FIGS. 38 and 39. FIG. 39 shows the string 600 supported by by the hook 73c.

I claim:

1. A game racket and string system therefor comprising a racket frame having an unstrung open head portion, a handle portion and an intermediate throat portion, said head portion having string support means spaced about the inner periphery of said head portion for receiving said string system, said string system having substantially parallel runs of interwoven strings at right angles to each other, adjacent pairs of similarly oriented strings forming loops around the outer periphery of said string system with four terminal loops each formed by one run of string secured to itself, each of said loops and terminal loops respectively corresponding in spacing to the spacing of said string support means, the planar dimensions of the outer periphery of said string system in its normal, unstrung nontensioned condition being less by a predetermined amount than the planar dimension defined by the interior periphery of said string support means, whereby the respective loops of said string system are adapted to be directly stretched onto their respective string support means and result in a strung racket of a desired tension as determined by said predetermined lesser dimension of said string system.

* * * * *